US006732699B2

(12) United States Patent
Wakade et al.

(10) Patent No.: US 6,732,699 B2
(45) Date of Patent: May 11, 2004

(54) CAST IRON CYLINDER LINER WITH LASER-HARDENED FLANGE FILLET

(75) Inventors: Shekhar G. Wakade, Grand Blanc, MI (US); Paul Noles Crepeau, Clawson, MI (US); Grant K. Tappen, Washington, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/264,697

(22) Filed: Oct. 4, 2002

(65) Prior Publication Data

US 2004/0065290 A1 Apr. 8, 2004

(51) Int. Cl.[7] ..... F02F 7/00
(52) U.S. Cl. ..... 123/193.2
(58) Field of Search ..... 123/193.2, 448; 524/503

(56) References Cited

U.S. PATENT DOCUMENTS 4,093,842 A * 6/1978 Scott ..... 524/503
6,041,749 A * 3/2000 Lubbing et al. ..... 123/193.2
6,328,026 B1 * 12/2001 Wang et al. ..... 123/668
6,390,050 B2 * 5/2002 Feikus ..... 123/193.2
6,575,130 B2 * 6/2003 Feikus ..... 123/193.2

* cited by examiner

*Primary Examiner*—Marguerite McMahon
(74) *Attorney, Agent, or Firm*—Leslie C. Hodges

(57) ABSTRACT

A cast iron cylinder liner for an engine has a body with a radial upper flange and a generally cylindrical wall extending axially from an inner portion of the flange. An arcuate fillet is formed at a juncture between the upper flange and an exterior of the cylindrical wall. To strengthen the juncture of thin wall liners, for example with wall thickness less than 2.5 mm, a portion adjacent the fillet is laser hardened to a selected depth of the wall, thus increasing resistance to stresses created in the wall when the liner is installed and operating in an engine.

8 Claims, 2 Drawing Sheets

CAST IRON CYLINDER LINER WITH LASER-HARDENED FLANGE FILLET

TECHNICAL FIELD

This invention relates to cast iron cylinder liners, particularly for use in engines having aluminum cylinder blocks.

BACKGROUND OF THE INVENTION

It is known in the art relating to cast iron cylinder liners made for use in aluminum block engines to design the liners as cast iron sleeves each with a cylindrical body connected at the top with a radially extending flange. After casting, the outer diameters (ODs) of the liner are precision machined to the proper dimensions. After being press fitted into cylinder bores of an engine, the inner diameters (IDs) of the liners are precision machined. In the assembled engines, the liners are held in place by the retaining force of a cylinder head and associated head gasket engaging upper surfaces of the liners including the flanges. Alternatively, liners may be rough machined on the ODs and cast in place inside aluminum cylinder blocks.

In some applications where the cylinder wall is machined to a thickness of less than 2.5 mm, and particularly where it is 2.0 mm or less, the liner installation and assembly of the engine and the operating conditions in the engine may create undesired stress levels in the liner. The highest stresses generally occur at the location of an arcuate or radiused fillet at the juncture of the outer surface of the cylinder with the lower surface of the radial flange. At this point, the thickness of the cylinder wall is further reduced by an undercut provided at and/or adjacent to the fillet to provide for machining of the outer surface of the cylinder wall with room for tool run-out adjacent to the fillet.

Powertrain development continues to increase engine performance while providing reductions in engine mass and package size. This results in increased engine operational loads acting on the cylinder liners. It is thus desirable to produce thin wall liners modified to either reduce the stress levels and/or increase the strength in the fillet area to provide extended durable operation without significantly modifying the dimensions or the machinability of the liner itself.

SUMMARY OF THE INVENTION

The present invention provides a thin wall liner in which the strength of the liner is increased by laser hardening of a portion of the liner wall and the flange adjacent to the fillet at the juncture of the cylindrical wall and the radial flange. The laser energy is preferably applied at or adjacent the location of the fillet by rotating the liner about its axis as the laser energy is applied along the complete perimeter of the fillet portion. Alternatively, the laser beam may be moved around the perimeter of the stationary liner or applied in any other suitable manner.

The laser energy strengthens the portion of the liner wall and flange adjacent to the fillet by modifying the metallurgical structure of the cast iron through phase transformations as known in the art to create a stronger metallurgical structure in the treated portion. The laser treatment may include external quenching of the treated surface after laser heating. However, the treatment may also be conducted without quenching as desired to obtain the best results.

Preferably, the OD of the liner is completely machined before laser hardening. The depth of laser hardening may be varied as necessary to obtain the needed strength at the fillet location. However, it is preferable that the depth of the laser-hardened portion be maintained relatively small to avoid excessive distortion of the machined dimensions of the liner due to the laser treatment.

In a preferred embodiment, the laser hardening pattern extends from the fillet into the flange and into not more than half the thickness of the adjacent liner wall. In an alternative embodiment, the hardened pattern extends into more than half the thickness of the adjacent liner wall to provide increased strength to the fillet portion. In a third embodiment, the laser-hardened portion extends from the fillet through the full thickness of the liner wall adjacent to the fillet. While this provides increased strength, distortion of the upper portion of the liner may require additional machining of the liner bore and fillet area. While this may be done, it is preferred to avoid subsequent machining because machining of hardened portions of the liner causes increased wear of the cutting tools.

Preferably, the fillet is formed as a radius. The adjacent undercut is preferably formed as a tapered or slightly conical area connecting the fillet with a cylindrical portion of the liner wall. However, the fillet may have an arcuate form other than that of a radius and the undercut may be other than conical.

It is known that cylinder bore surfaces have been laser hardened to reduce wear and scuffing of the cylinder surface. However, it is believed that laser treatment of a thin wall liner flange fillet to strengthen the wall for durability has not been previously contemplated or developed.

These and other features and advantages of the invention will be more fully understood from the following description of certain specific embodiments of the invention taken together with the accompanying drawings.

DESCRIPTION OF THE PREFERRED EMBODIMENT

Figure 1:
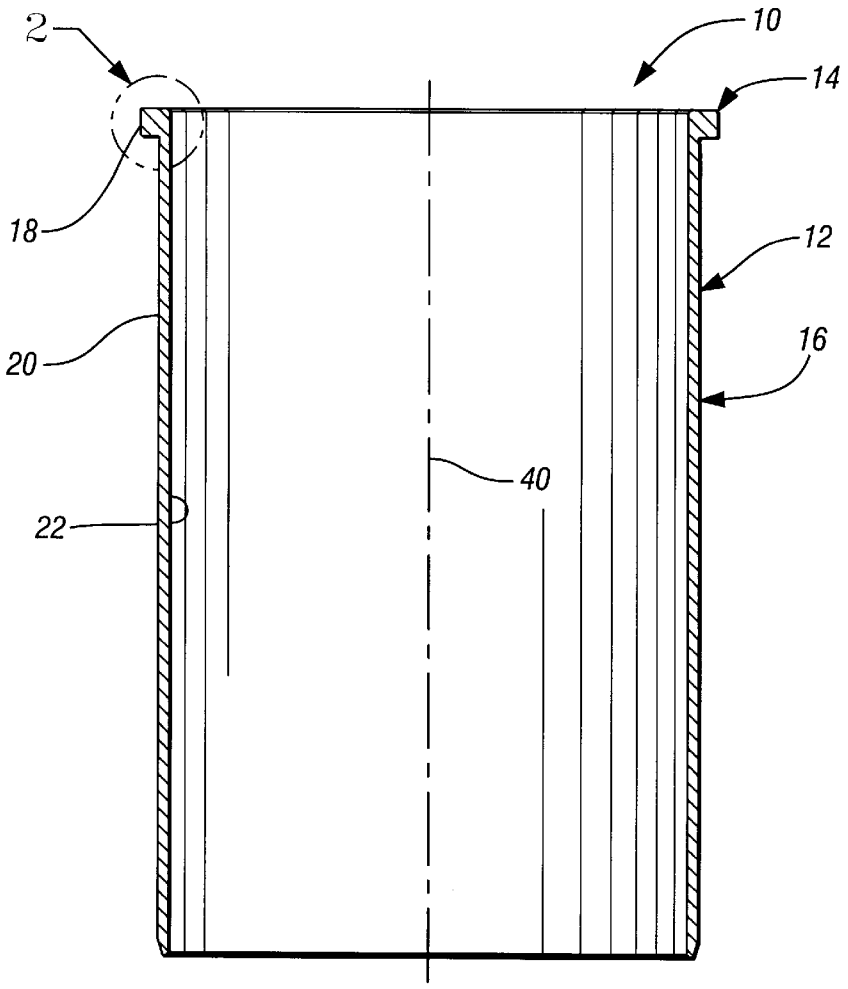
FIG. 1 is a transverse cross-sectional view through the central axis of a cylinder liner formed according to the invention.

Referring first to FIG. 1 of the drawings in detail, numeral 10 generally indicates a cast iron cylinder liner or sleeve having a cast body 12 including a radially extending upper flange 14 and a generally cylindrical wall 16. The wall 16 extends axially downward from an inner portion of the flange at a juncture 18 between the upper flange 14 and a cylindrical outer surface 20 of the wall 16. An interior surface of the liner defines a bore 22 which extends through the upper flange 14 and the cylindrical wall 16 to form, when finished, a suitable sliding surface for aluminum pistons in an engine having an aluminum cylinder block.

In assembly, liner 10 is press fitted into an aluminum bore of an associated cylinder block, not shown, so that the cylindrical wall 16 is supported radially by the aluminum bore of the block. The flange 14 is received in an annular recess of the block around the upper end of the aluminum bore.

Figure 2:
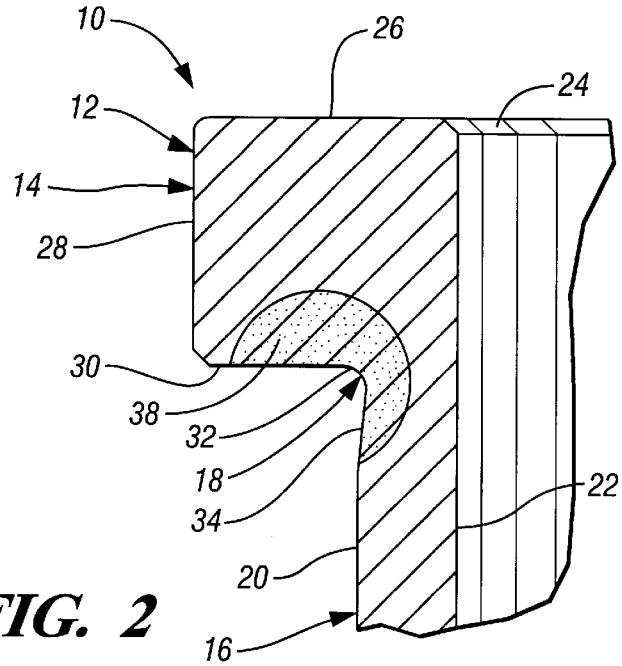
FIG. 2 is an enlarged view of the portion shown in circle 2 of FIG. 1 and showing a laser-hardened portion extending into less than half the thickness of the adjacent liner wall.

Referring to FIG. 2 of the drawings, there is illustrated an enlarged view of the upper end portion of the cylinder liner shown in circle 2 of FIG. 1. The inner surface or bore 22 of the liner extends axially to the upper end where a small chamfer 24 connects the bore with an upper surface 26 of the flange 14. A cylindrical outer surface 28 connects the upper surface downward with a lower surface 30 of the flange.

The flange lower surface 30 terminates inward at an arcuate fillet 32, preferably a radius, which is located at the juncture 18 of the flange 14 and cylindrical wall 16. Fillet 32 connects with a conical or angularly configured undercut 34 which merges into the cylindrical outer surface 20 of the cylindrical wall 16 at a short distance away from the juncture 18. The fillet may be other than a radius and the undercut may be other than conical.

In exemplary embodiments, the radial thickness of the wall 16 is less than 2.5 mm and may be not greater than about 2.0 mm. The radial thickness at the smallest diameter of the juncture 18 will be slightly less than the thickness of the cylindrical wall portion and thus will be less than 2.0 mm for a 2.0 mm wall.

Upon installation of the liner 10 in an engine and during operation of the engine, the thinnest portion of the cylinder wall at the connection of the undercut 34 with the fillet 32 may be subjected to the highest stresses applied to the body of the cylinder liner. To provide increased strength in this area and maintain durability under the higher stresses, the fillet area and the surrounding cast iron material is formed as a laser-hardened portion 38. The hardened portion extends generally upward into the lower portion of the flange and inward from the fillet and undercut area at the juncture 18.

In the exemplary embodiment of FIG. 2, the hardened portion of the liner extends radially inward a dimension slightly less than half the thickness of the adjacent liner wall. This increases the strength of the hardened liner area but minimizes distortion of adjacent precision machined portions of the liner by the laser heat treatment itself.

Any suitable manner of applying laser energy to the fillet area of the liner may be utilized. However, one suitable arrangement is to rotate the liner on its axis 40 while applying laser beam energy against the fillet area in a continuous manner as the liner rotates through 360 degrees or more. The heat-treated portion of the liner may be quenched if desired by any suitable manner, such as air or liquid application, or may be left unquenched if desired.

Figure 3:
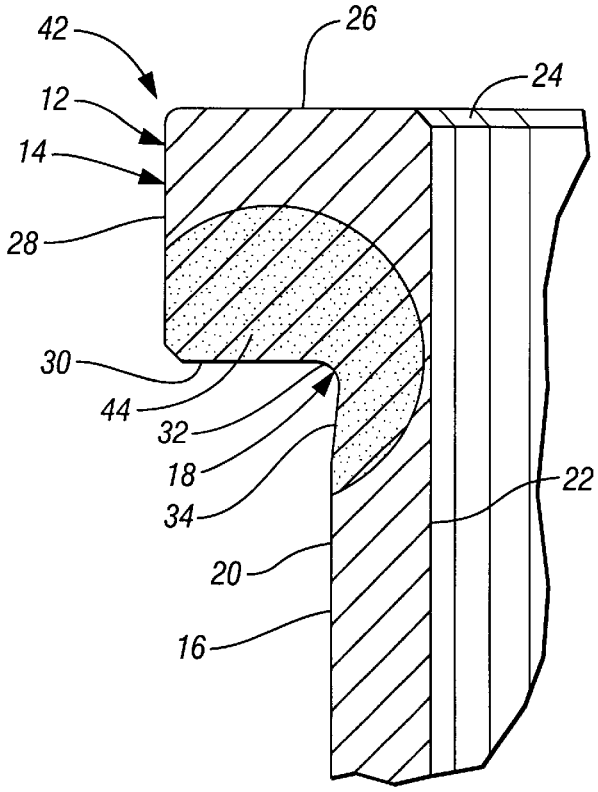
FIG. 3 is a view similar to FIG. 2 but showing a hardened portion extending into more than half the thickness of the adjacent liner wall.

Referring now to FIG. 3, an alternative embodiment of heat treated liner 42 is illustrated wherein like numerals indicate like parts or features. Liner 42 is similar to liner 10 except that the size of the laser-hardened portion 44 has been increased so that it extends further into the flange and across more than half the thickness of the cylindrical wall 16 but does not extend to the internal bore 22 of the cylinder liner. The feature of this design provides a flange and fillet area of further increased strength but also requires additional care to avoid undesired distortion of the liner during laser hardening, which may require additional machining of the liner prior to installation in the engine block.

Figure 4:
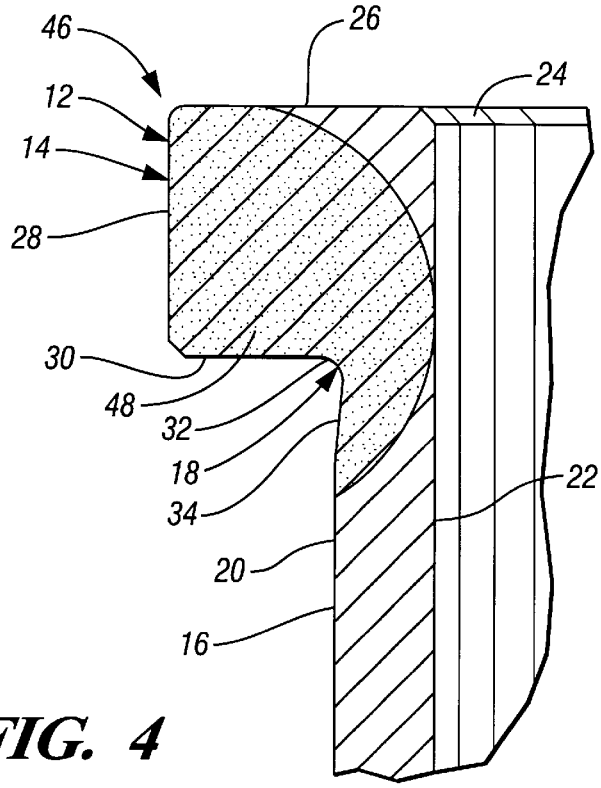
FIG. 4 is a view similar to FIG. 3 but showing a hardened portion extending through the full thickness of the adjacent liner wall.

Referring now to FIG. 4 of the drawings, there is shown in a view similar to FIGS. 2 and 3, a third embodiment of liner which is dimensionally similar or identical to the liners of FIGS. 2 and 3 and wherein like numerals indicate like parts or features. Liner 42 differs from liners 10 and 44, previously described, in that the laser-hardened portion 48 is increased so as to extend upward over a large portion of the flange and inward to extend through the liner wall to the bore 22 near the juncture 18 of the flange and outer wall 20 of the liner.

As described above, it is apparent that the various embodiments of cast iron cylinder liners, having varying degrees of local hardening at and adjacent a fillet between a radial flange and cylindrical wall, provide an increase in strength at the highest stressed location of the cast iron liner material to withstand the higher stresses at this location without materially changing the configuration and size of the liner itself. Accordingly, a more durable liner structure is provided for operation in an engine under predetermined assembly and operational loads with increased durability.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed:

1. A cast iron cylinder liner for an engine, the liner comprising:

a body having a radially extending upper flange and a generally cylindrical wall extending axially from an inner portion of the flange, the liner having an inner bore extending axially through the flange and the cylindrical wall; and an arcuate fillet, formed as a radius, is formed at a juncture between the upper flange and an exterior of the cylindrical wall;

wherein a portion of the wall and flange adjacent to the radius is laser hardened to strengthen the wall against stresses created therein when the liner is installed in an engine.

2. A cylinder liner as in claim 1 wherein the exterior of the cylindrical wall has a radial undercut at the location of the fillet.

3. A cylinder liner as in claim 2 wherein the thickness of the cylindrical wall below the undercut is less than 2.5 mm.

4. A cylinder liner as in claim 2 wherein the thickness of the cylindrical wall below the undercut is not greater than about 2.0 mm.

5. A cylinder liner as in claim 4 wherein the thickness of the cylindrical wall in the undercut is less than 2.0 mm.

6. A cylinder liner as in claim 1 wherein the laser-hardened portion extends from the fillet into the flange and into not more than half the thickness of the adjacent liner wall.

7. A cylinder liner as in claim 1 wherein the laser-hardened portion extends from the fillet into the flange and into more than half the thickness of the adjacent liner wall.

8. A cylinder liner as in claim 1 wherein the laser-hardened portion extends from the fillet into the flange and through the full thickness of the adjacent liner wall.

* * * * *